US006510858B1

(12) United States Patent
Halstead et al.

(10) Patent No.: US 6,510,858 B1
(45) Date of Patent: Jan. 28, 2003

(54) LOAD LIFTING/LOWERING MECHANISM FOR A WASHER

(75) Inventors: Eric Halstead, Beauport (CA); Francois Lagacé, Quebéc (CA); John Wood, Charlesbourg (CA); Simon Villeneuve, Beauport (CA); Jean-Guy Roy, Charny (CA); Eugéne Cantin, St. Louis-Pintendre (CA)

(73) Assignee: Steris Inc., Temecula, CA (US)

( * ) Notice: Subject to any disclaimer, the term of this patent is extended or adjusted under 35 U.S.C. 154(b) by 191 days.

(21) Appl. No.: 09/634,190

(22) Filed: Aug. 9, 2000

(51) Int. Cl.[7] ..... B08B 3/00

(52) U.S. Cl. ..... 134/57 D; 134/58 D; 134/115 R; 134/133; 134/143; 134/165

(58) Field of Search ..... 134/56 D, 57 D, 134/58 D, 115 R, 133, 143, 165, 200

(56) References Cited

U.S. PATENT DOCUMENTS 3,207,167 A * 9/1965 Edstrom ..... 134/141
3,612,253 A * 10/1971 Hoffman et al. ..... 134/165
5,115,822 A * 5/1992 Nichols ..... 134/135
5,687,752 A * 11/1997 Boylan ..... 134/115 R
6,095,165 A * 8/2000 Mastronardi ..... 134/115 R

* cited by examiner

*Primary Examiner*—Randy Gulakowski
*Assistant Examiner*—Joseph Perrin
(74) *Attorney, Agent, or Firm*—Fay, Sharpe, Fagan, Minnich & McKee, LLP

(57) ABSTRACT

A washing device (10) includes a chamber (12) with a front door (24). The door is pivotable between a vertical closed position and a horizontal open position. An article carrying assembly (34) is moveable from inside the washing device to an upper surface (26) of the open door. A lifting system (72) moves the front door between lower and upper positions (74, 76). The lifting system includes a follower (154) to which the front door is pivotally mounted. A motor (80) transmits power to a pair of chains (110, 116), which drive the follower along a guide (156) to move the door up and down. Alternatively, the lifting system includes a cable (182) coupled to a fluid cylinder (180). When the door is in the upper position, an operator can move the rack to a transfer cart or load and unload the article carrying assembly, all while in a substantially erect position.

25 Claims, 7 Drawing Sheets

LOAD LIFTING/LOWERING MECHANISM FOR A WASHER

BACKGROUND OF THE INVENTION

The present invention relates generally to the cleaning and decontamination art. It finds particular application in conjunction with washers for washing instruments and equipment such as surgical, medical, dental, veterinary, and mortuary instruments and equipment which contain, or potentially contain, biological contaminants and will be described with reference thereto. It is to be appreciated, however, that the invention will also find application in conjunction with washing, sanitizing, and disinfecting equipment of various types.

Medical, dental, surgical, veterinary and laboratory equipment and instruments have been cleaned and/or sterilized in a number of different ways, such as by water/detergent washing, steam, hydrogen peroxide or other vapor treatments, or reagent treatments. Known under counter washing systems, for cleaning equipment and instruments of the foregoing nature, operate much like household dishwashers and typically include a washing chamber defined by opposed sidewalls, a rear wall, opposed upper and lower walls, and a front door. At least one slidable rack or basket is disposed within the chamber for carrying the various instruments and/or equipment to be cleaned.

The front door of known under counter washing systems is generally pivotally attached to a lower portion of the front of the washing system and is configured to selectively pivot between a closed vertical position and an open horizontal position. When the door is in the open horizontal position, the rack or basket slides out of the washing chamber on side rails or an upper surface of the door. Assuming the rack or basket is full, it is unloaded and then reloaded while being supported by the front surface of the door. After being loaded, the rack or basket is slid back in to the washing chamber and the door is pivoted to the vertical closed position. In this position, the washing system is sealed and ready for operation.

Although this type of system effectively cleans and dries a variety of different types of instruments and equipment, it has some drawbacks, particularly during loading and unloading operations. For a number of reasons, some of which are obvious, mounting washing systems under a standard counter where they are supported by a floor surface is convenient, efficient, aesthetically pleasing, and maximizes work surface area. During loading and unloading of the washer system, the washer door is pivoted to the horizontal open position where it lies in a horizontal plane that is relatively close to the floor surface. Thus, the rack or basket being supported by the top surface of the pivotable door is located at a low working position which is difficult for an operator to reach. An operator generally has to bend over to load and unload the rack or baskets.

This "bent-over" working position may be acceptable for general household use where an operator is only loading and unloading the washer a few times a day. However, a "bent-over" working position can become extremely arduous and uncomfortable for an operator whose duties include multiple loadings and unloadings of a washing system throughout the course of an entire work day. Operators having such duties are common in the medical, dental, surgical, veterinary and laboratory fields. Moreover, the loading and unloading of washing systems in these fields is relatively long when compared to loading and unloading a traditional household washer. Such repetitive loading and unloading in the "bent-over" position for extended periods of time is a factor which may cause or lead to back injuries for operators. Alternatively or in addition, such activity may lead to back pain or severe discomfort.

The present invention provides a new and improved construction which enables a user to load and unload the washing system in an upright position, thereby overcoming the above-referenced problems and others.

SUMMARY OF THE INVENTION

In accordance with one aspect of the present invention, a washer comprises a washing chamber defined by a series of walls. A front door is disposed adjacent a front portion of the washer and has an inner surface and an outer surface. The front door is selectively pivotable between a horizontal open position and a vertical closed position. An article carrying assembly is provided for containing a series of articles to be cleaned by the washer. The article carrying assembly is selectively moveable between a position inside the washing chamber and a position on the inner surface of the front door. A lifting system is coupled to the front door. The lifting system is configured to selectively move the front door and the article carrying assembly supported thereon in the vertical direction between a first lower position and a second upper position. The front door in the upper position allows an operator to load and unload the carrying assembly in a substantially upright position.

In accordance with another aspect of the present invention, a washer comprises a washing chamber defined by a series of walls. A front door is disposed adjacent a front portion of the washer. The front door is selectively pivotable between an open position and a closed position. A mechanical lifting system is coupled to the front door. The mechanical lifting system mechanically moves the front door between a first lower position and a second upper position. The front door in the upper position allows an operator to load and unload the washer in a substantially upright position.

In accordance with another aspect of the present invention, a method of loading and unloading a washer includes pivoting a front door of a washer to an open horizontal position. An article carrying device is slid from a washer chamber on to an upper surface of the open front door. The front door is then raised to an upper position where an operator can load and unload the article carrying device in an upright and ergonomic position. The article carrying device is unloaded and reloaded in the upper position. The front door is then lowered to a lower position and the article carrying device is slid into the washing chamber. Finally, the front door is closed.

A first advantage of the present invention is that it enables an operator to perform loading and unloading operations in an upright, ergonomic position.

Another advantage of the present invention is that is lifts loads smoothly.

Yet another advantage resides in reduced operator injuries and muscle strain.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED INVENTION

Figure 1A:
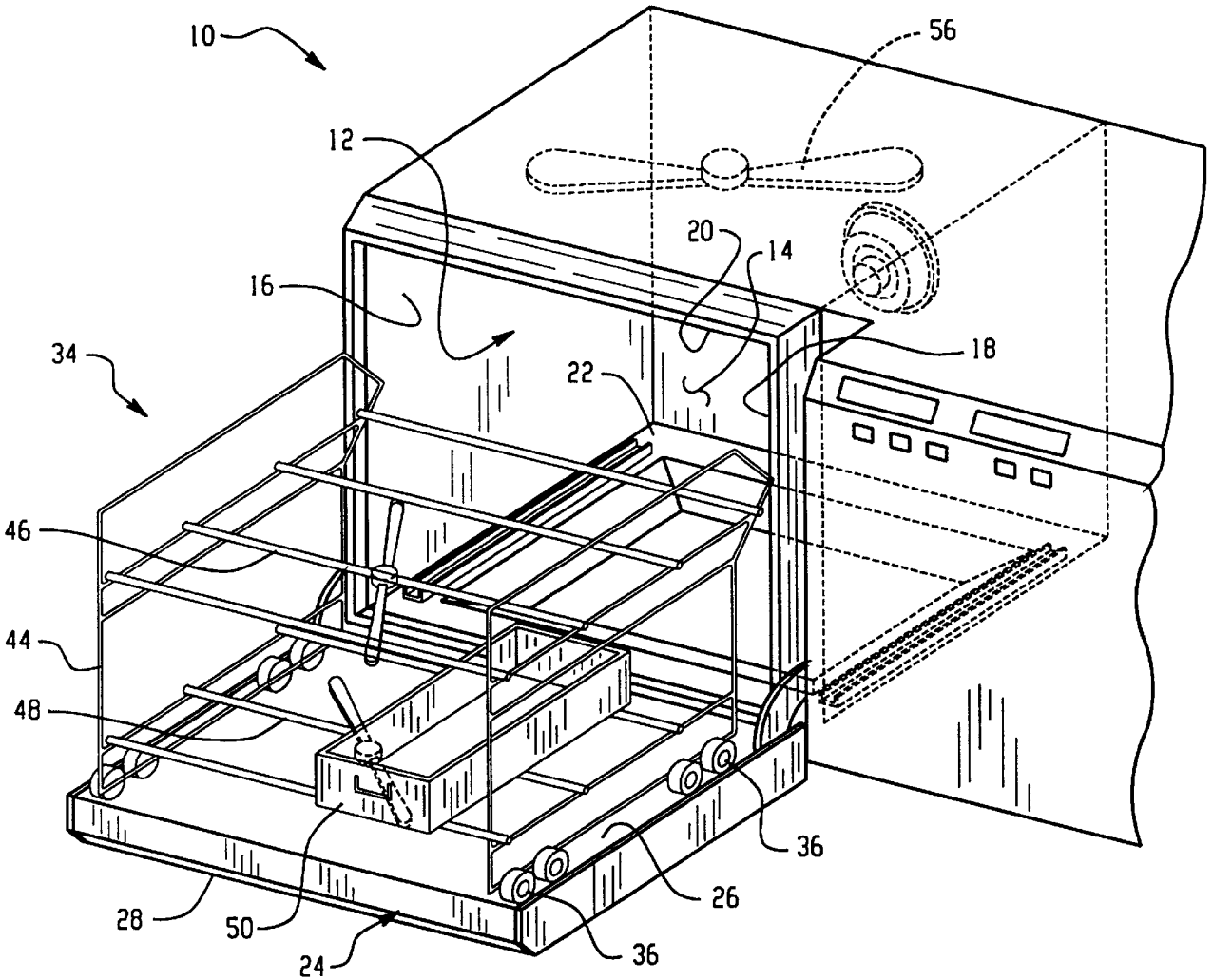
FIG. 1A is a perspective view of a washing device in accordance with the present invention having a front door that is open and in a lower position.
Figure 1B:
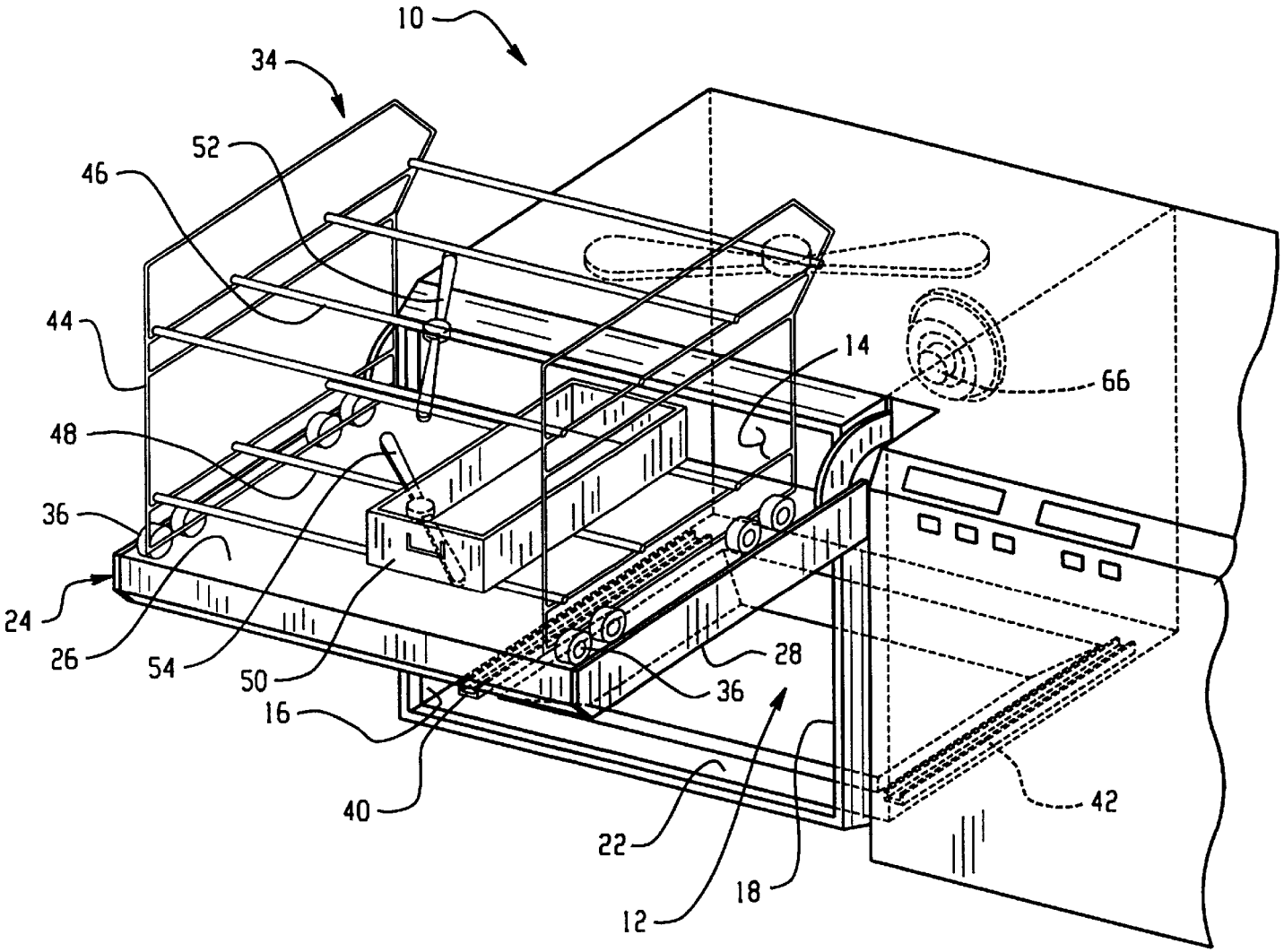
FIG. 1B is a perspective view of the washing device of FIG. 1A with the front door located in an upper position.

With reference to FIGS. 1A and 1B, a washing device 10 includes a washing chamber 12 defined by a back wall 14, opposing side-walls 16, 18, opposing top and bottom walls 20, 22 and a front door 24. The front door 24, which has an upper surface 26 and a lower surface 28, is selectively pivotable between a vertical closed position and a horizontal open position. The walls and door defining the washing chamber are preferably constructed from stainless steel. However, it will be appreciated that other materials, such as high impact plastic materials, may be used to construct the walls and door.

A rack 34, for carrying articles such as medical equipment and instruments, is configured to roll in and out of the washing chamber. The rack is supported by a plurality of wheels 36 which allows it to be easily rolled in and out of the washing chamber. It will be appreciated, however, that the rack may be supported by any other means such as low coefficient of friction slide blocks. While the rack is disposed within the washing chamber, the wheels are supported by a pair of flanged members 40, 42 which extend horizontally inward from the opposing sidewalls 16, 18 respectfully. When the rack is rolled out of the washing chamber it is supported by the upper surface 26 of the front door 24.

The rack preferably includes a frame 44, an upper shelf 46 and a lower shelf 48. The upper and lower shelves are each dimensioned to support at least one basket 50 which carries articles to be cleaned. Rotary spray heads 52, 54, having a series of nozzles, are rotatably mounted beneath the upper and lower shelves 46, 48 respectively. Rotary spray heads 56 on the ceiling and stationary nozzles are also contemplated. During operation, the spray heads rotate about a vertical axis and provide cleaning solutions at high impact velocity to the articles within the washing chamber.

Figure 2:
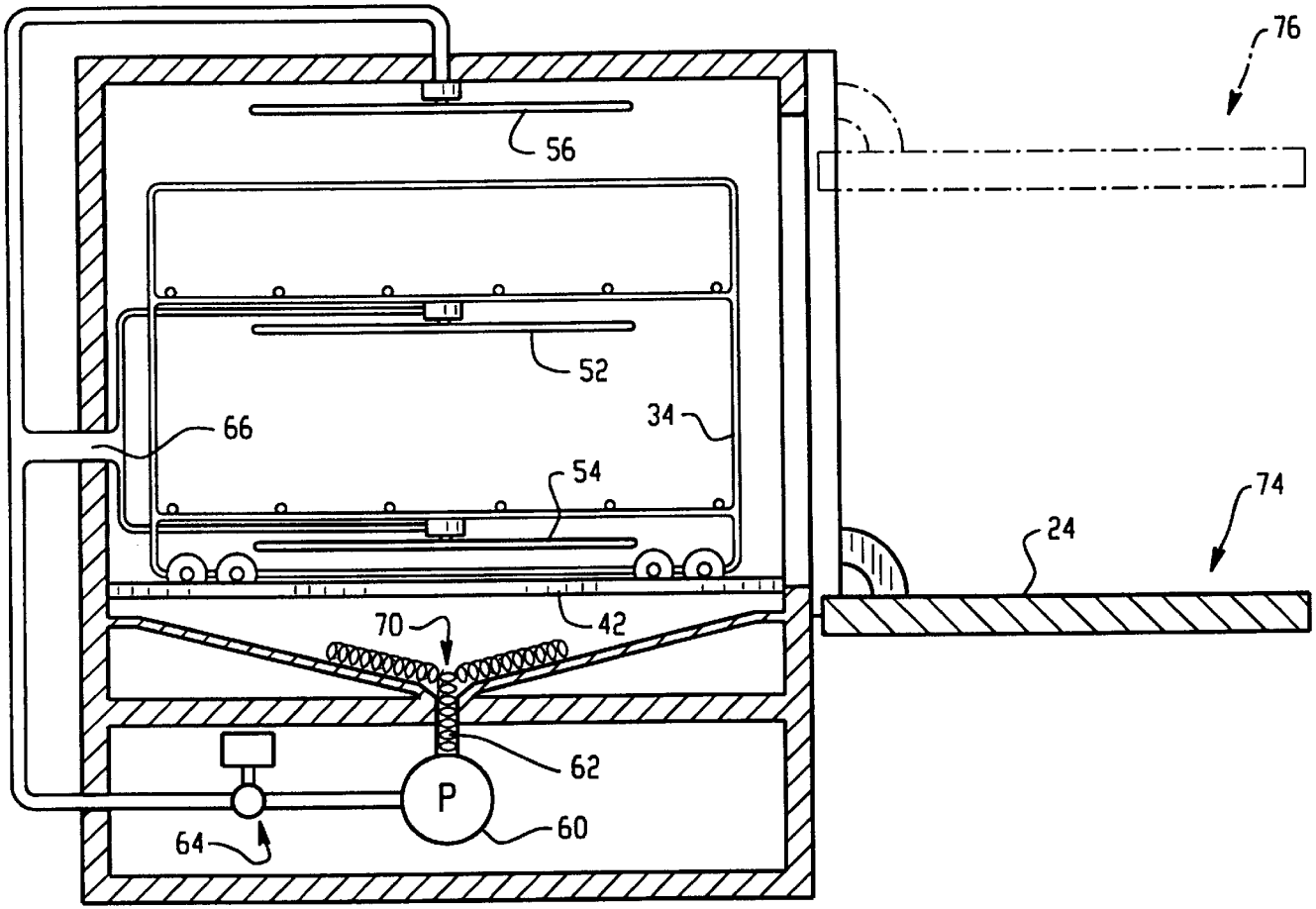
FIG. 2 is a side cross sectional view of the washing device showing the front door in the lower position and also showing the front door in phantom while in the upper position.

With reference to FIG. 2, a pump 60 is disposed below the bottom wall 22 of the washing chamber 12 in order to provide cleaning solutions, such as water, detergent, etc., to the spray nozzles. To heat the water as it collects in a sump defined above the bottom wall 22, a heating source 62, such as a heating coil, is disposed in the sump. A cleaning dispenser 64 injects detergent, disinfectants, corrosion inhibitors, and other cleaning agents into the heated water after the water has exited the pump. When the rack is slid into the washing chamber, a fluid sealing connector, provided on a rear portion of the rack, engages a connection member 66 located on the back wall 14 of the washing chamber. Thus, the cleaning solutions travel through connection member 66 and are directed to the spray heads where the solutions exit through the nozzle openings. The water, detergent, etc. pass through a drain 70 associated with the bottom wall of the washing chamber.

When it is desired to load or unload the washing device 10, the front door 24 is pivoted to the horizontal open position and the rack 34 is rolled out on to the upper surface 26 of the front door. At this position, the door and rack are located relatively close to the floor surface.

In order to facilitate loading and unloading of the rack in the present invention, a lifting system 72 (see FIG. 3A) selectively moves the front door in the vertical direction between a first lower position 74 and a second upper position 76. During loading and unloading of the washing device, the lifting system mechanically raises the door and supported rack to the upper position. In the upper position, the rack is either rolled onto a transfer cart which is unloaded at a storage cite or unloaded directly. This enables a user to load and unload the rack while remaining in an ergonomic upright position. Furthermore, the potential for operator back injuries, back pain, discomfort, etc. is reduced. After the rack has been loaded or unloaded, the door is mechanically moved to the lower position where the rack can be easily rolled in to the washing chamber.

Figure 3A:
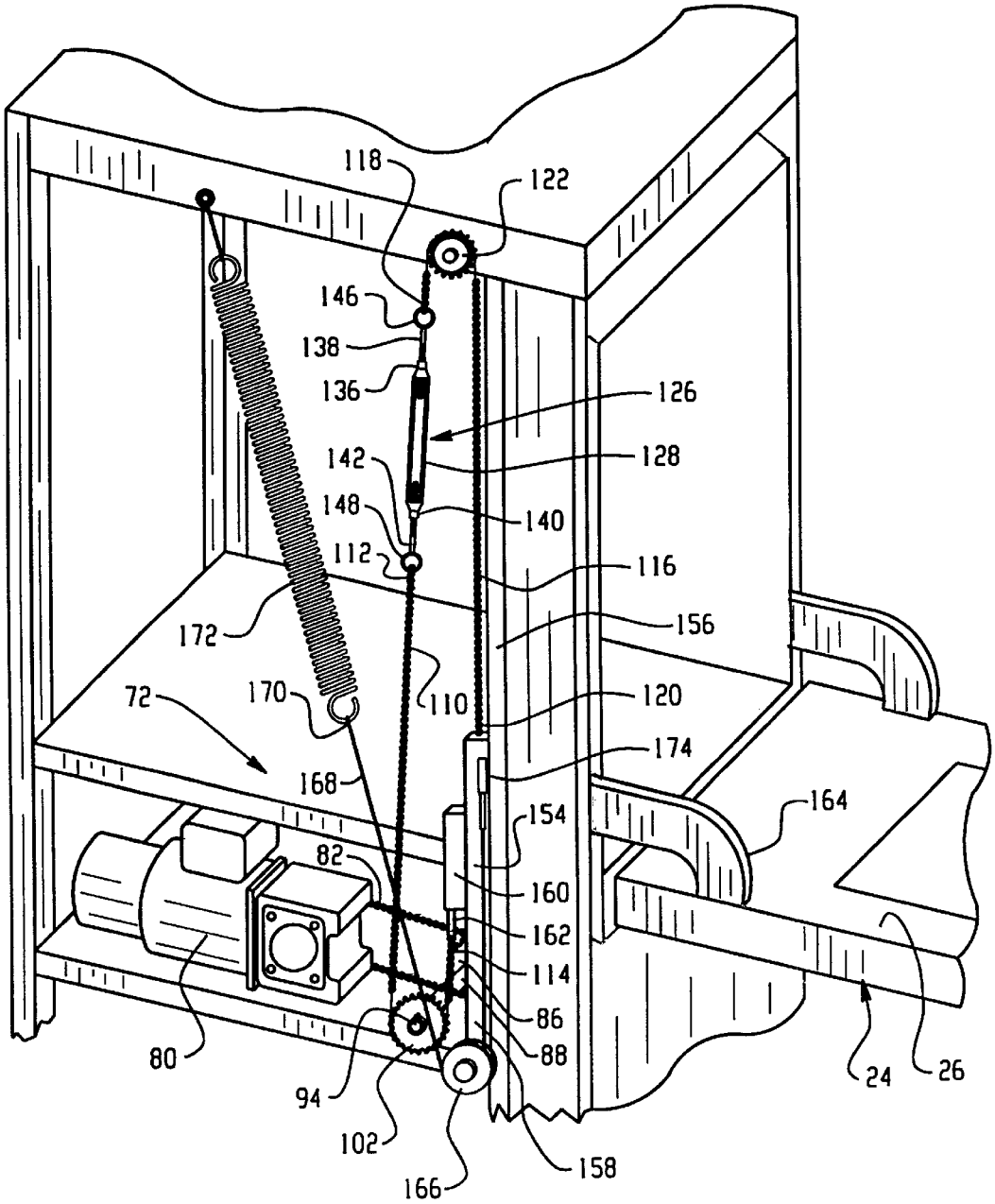
FIG. 3A is a side perspective view of a lifting assembly configured to move the front door between an upper position and a the lower position.
Figure 3B:
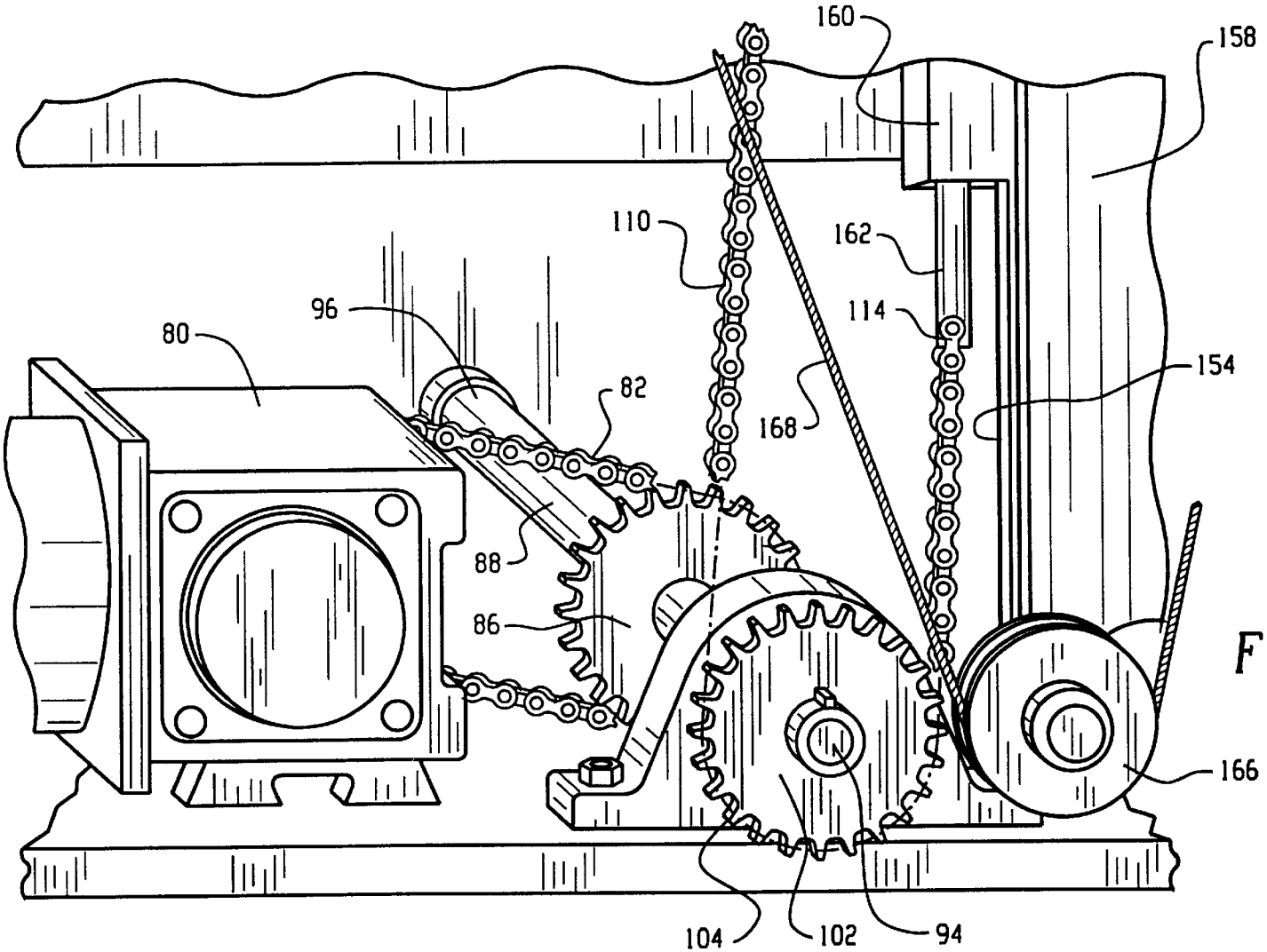
FIG. 3B is a perspective view of a motor, two sprockets and two chains which are used to help drive the door between the upper and the lower position.

With reference to FIGS. 3A and 3B, the mechanical lifting system includes a gear motor 80 configured to drive a first chain 82. The first chain engages a first sprocket 86 that is operatively connected to a horizontal shaft 88. Sprocket 86 transmits power from the first chain to the horizontal shaft, thereby rotating the shaft about its central horizontal axis. The horizontal shaft extends across the width of the washing device and has opposing first and second axial ends 94, 96.

Figure 4:
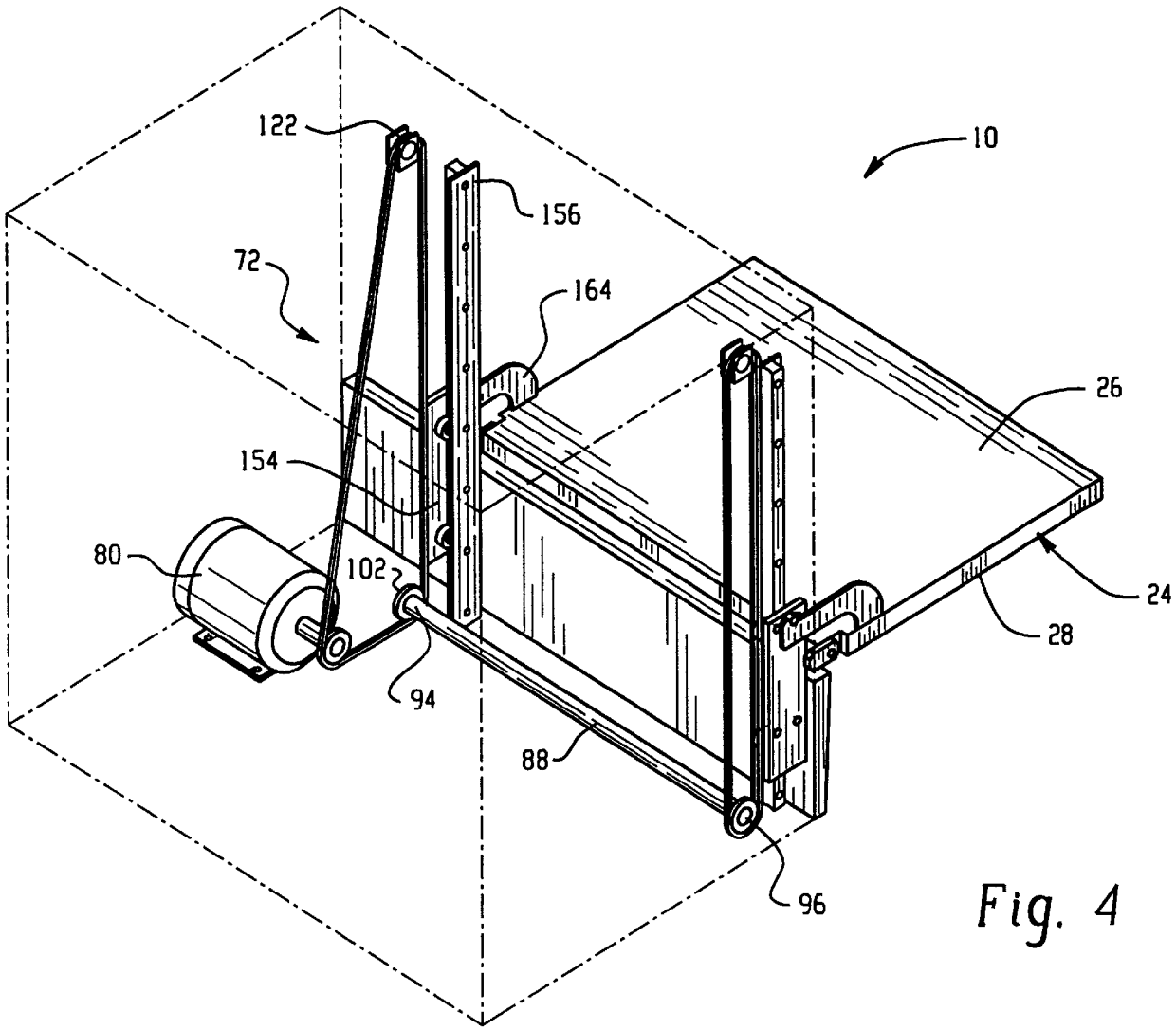
FIG. 4 is a perspective view of a simplified version of the washing device in accordance with the present invention.

In a preferred embodiment, a first series of components are operatively associated with the first axial end 94 of the horizontal shaft 88 and a second series of components are operatively associated with the second axial end 96 of the horizontal shaft (see FIG. 4). Both series of components are driven by the horizontal shaft and are configured to selectively move the front door between the lower position and the upper position. The first and second series of components are disposed on opposite sides of the washing device 10 and are preferably identical. Thus, reference will be made only to one series of components, namely those associated with the first axial end of the horizontal shaft as shown in FIGS. 3A and 3B.

The first series of components includes a second sprocket 102 having a plurality of teeth 104 disposed around its periphery. Sprocket 102 is operatively attached to the first axial end of the horizontal shaft. A second chain 110, having a first end 112 and a second end 114, engages sprocket 102. A third chain 116, having a first end 118 and a second end 120, engages a third free moving sprocket 122 located on an upper side portion of the washing device. The first end of chain 110 and the first end of chain 116 are interconnected by a tension control member 126.

The tension control member preferably includes a body 128 having an upper end and a lower end. The upper end of the body has an aperture 136 dimensioned to receive an upper fastener 138. Similarly, the lower end of the body includes an aperture 140 dimensioned to receive a lower fastener 142. The upper and lower fasteners each include a ring 146, 148 located at their free axial end. Ring 146 and ring 148 are operatively connected to the first end 112 of the second chain 110 and the first end 118 of the third chain 116 respectfully. The fasteners may be tightened or loosened in order to adjust the tension of the chains to a desired level.

With continued reference to FIGS. 3A and 3B, a follower 154, which is constrained to a vertical guide 156, interconnects the second end 114 of chain 110 and the second end 120 of chain 116. The follower 154 includes a substantially rectangular body 158 and a block member 160 fastened to a side portion of the rectangular body. The second end 114 of chain 110 is operatively connected to an elongated rod 162 extending downwardly from a bottom surface of block member 160. The second end 120 of chain 116 is operatively connected to a top surface of block member 160. The door is pivotably mounted to the block member 160.

A semicircular connecting member 164 extends from the upper surface 26 of the front door 24 and is slidably mounted to the rectangular body 158 of the follower. In addition, a pulley 166 is rotatably mounted to a lower side surface of the rectangular body. An elongated wire 168, having a first end 170 attached to a tension spring 172 and a second end 174 attached to the connecting member 164, engages the pulley. The wire and tension spring apply a force to the front door which biases the door toward the closed partition causing the door to become substantially weightless. Thus, it is relatively easy for an operator to pivot the front door in the lowered position to the vertical closed position. As the door is raised, the spring 172 contracts, reducing or eliminating the biasing force.

As noted above, the second series of components associated with the second axial end 96 of the horizontal shaft 88 are identical to the first series of components associated with the first axial end 94 of the horizontal shaft.

In operation, the front door 24 is pivoted to the horizontal open position. The rack 34 is rolled out of the washing chamber 12 on to the upper surface 26 of the front door. A first push button is pressed which actuates the gear motor 80. The motor drives the first and second series of components which raise the door until the follower 154 reaches a set of upper limit switches mounted at the top of the guide 156 where the front door stops in the upper position. Assuming the rack is fully loaded, the operator removes the cleaned articles from the rack and replaces them with articles which need to be cleaned. This is all done while the operator is in an upright, ergonomic position. When unloading and loading is complete, a second push button is pressed which causes the door to move vertically downward to the lower position where the follower engages a lower limit switch. The rack is easily rolled back in to the washing chamber. The front door is then pivoted to the vertical closed position so that the washing device is sealed and ready for another cleaning cycle.

In an alternate embodiment, the horizontal shaft 88 may be configured so that it does not extend across the entire width of the washing device. In such an embodiment, only the first series of components are provided for moving the front door 24 between the upper and lower positions. To prevent the follower and slide from binding, an upward biasing force is preferably applied to the side of the front door opposite the first series of components. Such a force causes the side of the door opposite the first series of components to become substantially weightless. The continuous force is preferably applied by a spring loaded assembly.

Figure 5:
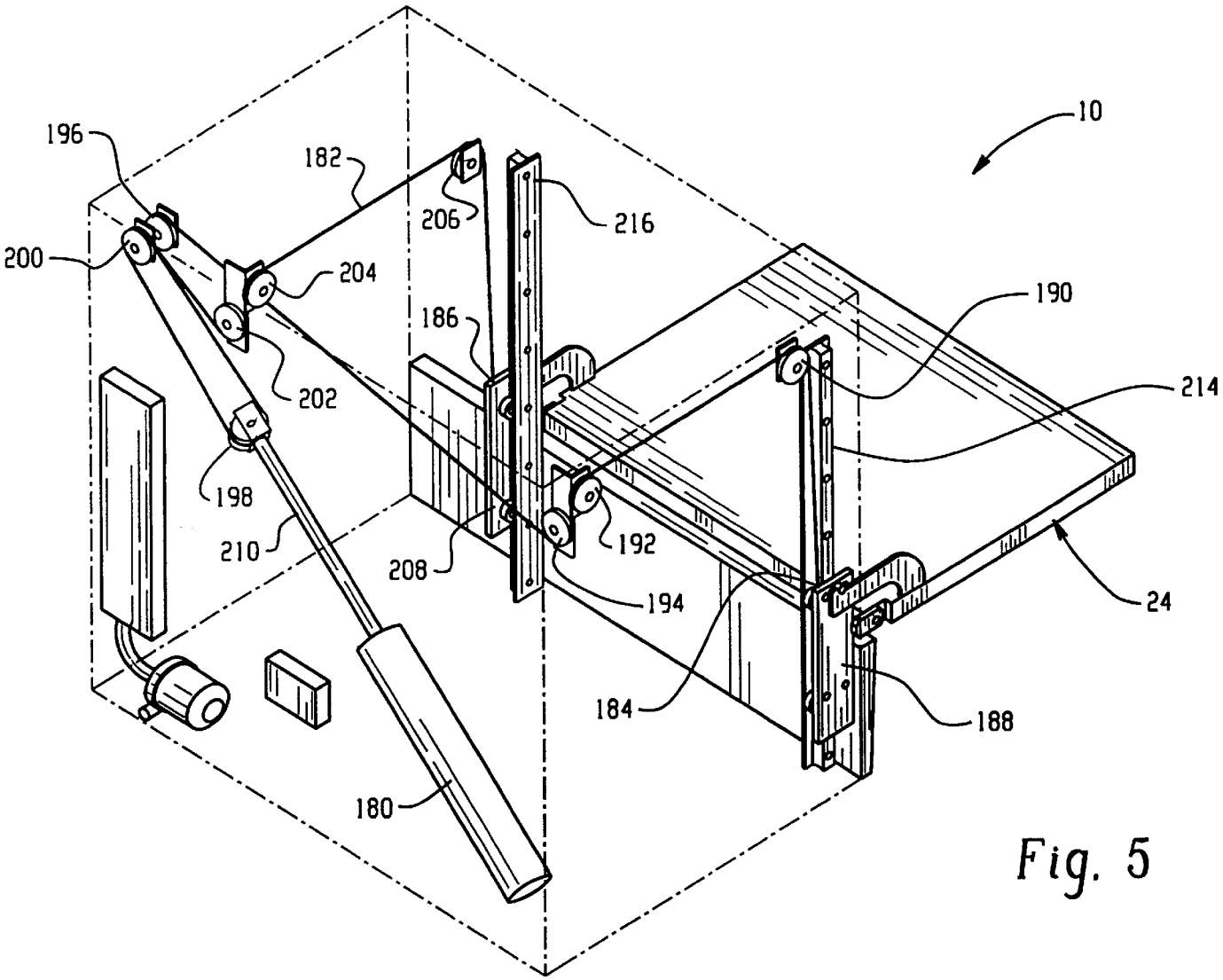
FIG. 5 is a perspective view of a lifting assembly for a washing device in accordance with an alternate embodiment of the present invention.

Turning now to FIG. 5, another alternate embodiment is shown. In this embodiment, the lifting system includes a fluid cylinder 180, such as a hydraulic pneumatic cylinder, which drives the front door 24 between the first lower position 74 and the second upper position 74. A cable 182, having a first end 184 and a second end 186, is coupled to the fluid cylinder and engages a series of pulleys arranged at predetermined locations around the washing device. The cable extends from a first follower 188, to a first pulley 190, to a second pulley 192, to a third pulley 194, to a fourth pulley 196, to a fifth pulley 198, to a sixth pulley 200, to a seventh pulley 202, to an eighth pulley 204, to a ninth pulley 206, and terminates at a second follower 208. An extendable and retractable arm 210 extends from the fluid cylinder and is operatively connected to pulley 198.

In operation, the front door is opened to its horizontal position. Arm 210 of the fluid cylinder is retracted causing cable 182 to apply a pulling force on the first and second followers 188, 208. The pulling force slides the first and second followers vertically upward along first and second vertical guides 214, 216 respectively. Thus, the front door, which is pivotally mounted to the first and second followers, is raised to the upper position where an operator can unload and load an article carrying assembly in an erect ergonomic position. When unloading and reloading is complete, the fluid cylinder extracts the arm which releases the pulling force applied to the front door. The front door then lowers to the lower position where the article carrying assembly can be placed back within the washing chamber 12.

The present invention has been described with reference to a preferred embodiment. obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A washer comprising:

a washing chamber defined by a series of walls;

a front door disposed adjacent a front portion of the washer having an inner surface and a outer surface, the front door being selectively pivotable between a horizontal open position and a vertical closed position;

an article carrying assembly for containing a series of articles to be cleaned by the washer, the article carrying assembly being moveable from a position inside the washing chamber to a position on the inner surface of the front door in the open position; and a lifting system coupled to the front door, the lifting system configured to selectively move the front door and the article carrying assembly supported thereon in the vertical direction between a lower position and an upper position, whereby in the upper position an operator can load and unload the carrying assembly in a substantially erect position.

2. The washer according to claim 1, wherein the lifting system includes a first vertical guide secured to a side of the washer and a first follower slidably connected to the first vertical guide, the front door being pivotally mounted to the first follower.

3. The washer according to claim 2, wherein the lifting system includes a second vertical guide secured to a side of the washer located opposite the first vertical guide and a second follower slidably connected to the second vertical guide, the front door being pivotally mounted to the second follower.

4. The washer according to claim 2, wherein the lifting assembly includes a motor that mechanically drives the first follower along the first vertical guide.

5. The washer according to claim 2, wherein at least one chain is operatively connected to the first follower.

6. The washer according to claim 5, wherein the lifting system includes a motor that mechanically drives the at least one chain in such a manner that the at least one chain drives the first follower to a desired position along the first vertical guide.

7. The washer according to claim 2, wherein a first end of a first chain and a first end of a second chain are operatively connected to the first follower, a second end of the first chain and a second end of the second chain are interconnected by a tension control member, the tension control member being configured to adjust the tension of the first and second chains to a desired level.

8. The washer according to claim 2, further comprising:

a pulley mounted to the first follower;

a cable having a first end coupled to a member extending from the front door, a second end coupled to a tension spring, and an intermediate portion engaging the pulley;

the cable and tension spring being configured to apply a biasing force on the front door to counter balance the gravitational forces on the front door in the lower position.

9. The washer according to claim 1, wherein the article carrying assembly includes a rack having a first shelf and a second shelf configured to carry at least one basket.

10. A washer comprising:

a washing chamber;

a door disposed adjacent a front portion of the washer, the front door being selectively pivotable between a horizontal open position and a vertical closed position;

an article carrying assembly for containing a series of articles to be cleaned by the washer; and a lifting system configured to selectively move the front door and the article carrying assembly supported thereon in a vertical direction between a lower position and an upper position, the lifting system including:

a first vertical guide secured to a side of the washer and a first follower slidably connected to the first vertical guide, the front door being pivotally mounted to the first follower;

at least one chain drive operatively connected to the first follower; and a motor which drives the at least one chain drive by transmitting power to a horizontal shaft that is operatively connected to the at least one chain drive by a sprocket, the at least one chain drive driving the first follower to a desired position along the first vertical guide.

11. A washer comprising:

a washing chamber defined by a series of walls;

a front door disposed adjacent a front portion of the washer having an inner surface and a outer surface, the front door being selectively pivotable between a horizontal open position and a vertical closed position;

an article carrying assembly for containing a series of articles to be cleaned by the washer, the article carrying assembly being moveable from a position inside the washing chamber to a position on the inner surface of the front door in the open position; and a lifting system coupled to the front door, the lifting system configured to selectively move the front door and the article carrying assembly supported thereon in the vertical direction between a lower position and an upper position, the lifting system including a fluid cylinder that selectively moves the front door between the lower position and the upper position.

12. The washer according to claim 11, wherein the lifting system includes a cable coupled to the fluid cylinder, the cable adapted to engage a plurality of pulleys and having a first end attached to a first follower and a second end attached to a second follower, the first follower and the second follower being configured to slide along a first vertical guide and second vertical guide respectively, the front door being pivotally connected to the first follower and the second follower.

13. A washer comprising:

a washing chamber defined by a series of walls;

a front door disposed adjacent a front portion of the washer, the front door being selectively pivotable between an open position and a closed position; and a mechanical lifting system coupled to the front door that mechanically moves the front door in the open position between a lower position and an upper position.

14. The washer according to claim 13, wherein the mechanical lifting system includes a first vertical guide secured to a side of the washer and a first follower slidably connected to the first vertical guide, the front door being pivotally mounted to the first follower.

15. The washer according to claim 14, wherein the mechanical lifting system includes a second vertical guide secured to a side of the washer located opposite the first vertical guide and a second follower slidably connected to the second vertical guide, the front door being pivotally mounted to the second follower.

16. The washer according to claim 14, wherein the mechanical lifting assembly includes a motor that mechanically drives the first follower and the second follower along the first vertical guide and the second vertical guide respectfully.

17. The washer according to claim 14, wherein a chain drive is operatively connected to the first follower.

18. The washer according to claim 17, wherein the mechanical lifting system includes a motor that mechanically drives the chain drive in such a manner that the chain drive moves the first follower to a desired position along the first vertical guide.

19. The washer according to claim 18, wherein the motor is adapted to transmit power to a horizontal shaft that is connected by a sprocket to the chain drive to the drive chain drive.

20. The washer according to claim 14, further comprising:

a pulley mounted to the first follower;

a cable having a first end coupled to a member extending from the front door, a second end coupled to a tension spring, and an intermediate portion engaging the pulley;

the cable and tension spring being configured to apply a biasing force on the front door, the such that biasing force biases the front door to the closed position when the door is in the lower position.

21. The washer according to claim 13, wherein the lifting system includes a fluid cylinder that selectively moves the front door between the first lower position and the second upper position.

22. The washer according to claim 21, wherein the lifting system includes a cable coupled to the fluid cylinder, the cable adapted to engage a plurality of pulleys and having a first end attached to a first follower and a second end attached to a second follower, the first follower and the second follower being configured to slide along a first vertical guide and second vertical guide respectively, the front door being pivotally connected to the first follower and the second follower.

23. A washer comprising:

a washing chamber;

a front door which selectively closes the chamber; and a mechanical lifting system coupled to the front door that mechanically moves the front door between a lower position and an upper position, the mechanical lifting system including a first vertical guide secured to a side of the washer and a first follower slidably connected to the first vertical guide, the front door being mounted to the first follower, a first end of a first chain and a first end of a second chain being operatively connected to the first follower, a second end of the first chain and a second end of the second chain being interconnected by a tension control member, the tension control member being configured to adjust the tension of the first and second chains to a desired level.

24. A washer comprising:

a washing chamber defined by a series of walls;

a door to the washing chamber, the door being selectively movable between an open position and a closed position;

a mechanical lifting system coupled to the door that mechanically moves the door between a lower position and an upper position; and a rack for carrying a series of articles to be cleaned by the washer, the rack being moveable from a position inside the washing chamber to a position on an upper surface of the door when the door is in the open position.

25. A washer comprising:

a washing chamber;

a door disposed adjacent a front portion of the washer, the door being selectively pivotable between an open position and a closed position;

a mechanical lifting means coupled to the door that mechanically moves the front door between a lower position and an upper position;

a means for biasing the door to pivot toward the closed position when the door is in the lower position, the biasing means inhibiting the door from pivoting toward the closed position when the door is in the upper position.

* * * * *